US009933748B2

(12) United States Patent
Yamaguchi et al.

(10) Patent No.: US 9,933,748 B2
(45) Date of Patent: Apr. 3, 2018

(54) IMAGE FORMING APPARATUS

(71) Applicant: FUJI XEROX CO., LTD., Tokyo (JP)

(72) Inventors: Mikio Yamaguchi, Kanagawa (JP); Yukihiro Ichiki, Tokyo (JP); Akira Arai, Tokyo (JP); Sho Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/356,025

(22) Filed: Nov. 18, 2016

(65) Prior Publication Data

US 2017/0343939 A1 Nov. 30, 2017

(30) Foreign Application Priority Data

May 25, 2016 (JP) ..... 2016-104659

(51) Int. Cl.
*G03G 21/16* (2006.01)
*G03G 15/20* (2006.01)

(52) U.S. Cl.
CPC ..... *G03G 21/1619* (2013.01); *G03G 15/2085* (2013.01)

(58) Field of Classification Search
None
See application file for complete search history.

(56) References Cited

U.S. PATENT DOCUMENTS 6,308,026 B1 * 10/2001 Kouchi ..... G03G 15/00 399/110
2004/0042039 A1 3/2004 Kodera et al.
2010/0142990 A1 * 6/2010 Mandel ..... B65H 29/00 399/107
2010/0196072 A1 * 8/2010 Hoover ..... G03G 15/0194 399/395

FOREIGN PATENT DOCUMENTS

JP 2004-093599 A 3/2004
JP 2008-009296 A 1/2008

* cited by examiner

*Primary Examiner* — Thomas Giampaolo, II
(74) *Attorney, Agent, or Firm* — Sughrue Mion, PLLC

(57) ABSTRACT

An image forming apparatus includes one or plural forming devices that form respective images on a recording medium that is being transported, a fixing device provided on a downstream side with respect to at least one of the forming devices in a direction of transport of the recording medium and that fixes the images formed on the recording medium, a delivering device that receives the recording medium transported in a first direction and discharges the recording medium in a second direction that is different from the first direction, and a supplying device that supplies the recording medium to any of the forming devices or to the delivering device. The forming devices, the fixing device, the delivering device, and the supplying device have respective housings and are each joinable to any of the other devices.

5 Claims, 14 Drawing Sheets

IMAGE FORMING APPARATUS

CROSS-REFERENCE TO RELATED APPLICATIONS

This application is based on and claims priority under 35 USC 119 from Japanese Patent Application No. 2016-104659 filed May 25, 2016.

BACKGROUND

Technical Field

The present invention relates to an image forming apparatus.

SUMMARY

According to an aspect of the invention, there is provided an image forming apparatus including one or plural forming devices that form respective images on a recording medium that is being transported, a fixing device provided on a downstream side with respect to at least one of the forming devices in a direction of transport of the recording medium and that fixes the images formed on the recording medium, a delivering device that receives the recording medium transported in a first direction and discharges the recording medium in a second direction that is different from the first direction, and a supplying device that supplies the recording medium to any of the forming devices or to the delivering device. The forming devices, the fixing device, the delivering device, and the supplying device have respective housings and are each joinable to any of the other devices.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
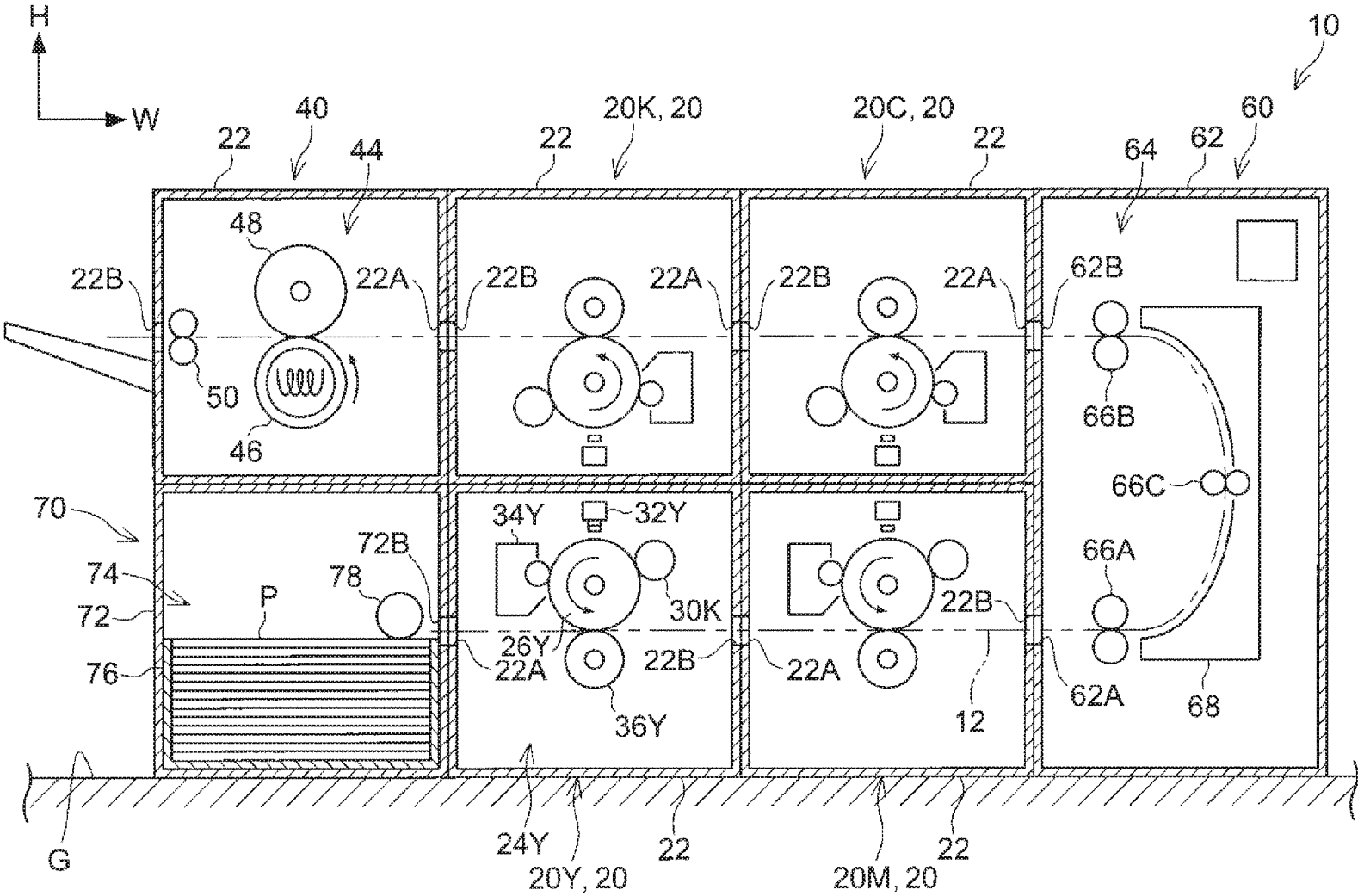
FIG. 1 is a schematic diagram of an image forming apparatus according to a first exemplary embodiment of the present invention.

An image forming apparatus according to a first exemplary embodiment of the present invention will now be described with reference to FIGS. 1 to 3. Arrows H, W, and D illustrated in the drawings represent an apparatus top-bottom direction (the vertical direction), an apparatus width direction (a horizontal direction), and an apparatus depth direction (another horizontal direction), respectively.

Overall Configuration

Figure 2A:
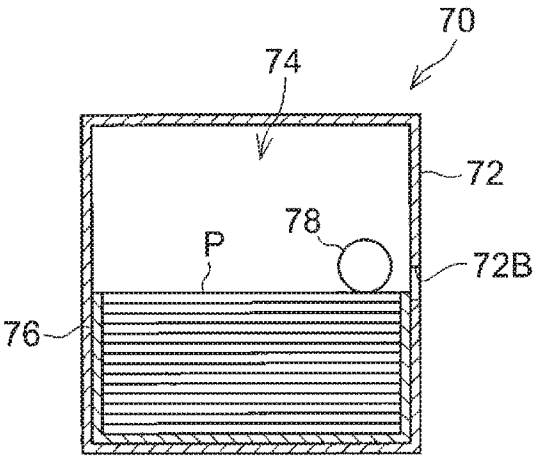
FIGS. 2A, 2B, and 2C are diagrams illustrating a supplying device, a forming device, and a fixing device, respectively, included in the image forming apparatus according to the first exemplary embodiment of the present invention.

Referring to FIG. 1, an image forming apparatus 10 according to the first exemplary embodiment is installed on a floor surface G. The image forming apparatus 10 includes plural forming devices 20 that form respective toner images on a sheet member P as a recording medium, a fixing device 40 that fixes the toner images on the sheet member P, a delivering device 60 that changes the direction of transport of the sheet member P, and a supplying device 70 that supplies the sheet member P.

Specifically, the forming devices 20 of the image forming apparatus 10 include a forming device 20Y that forms a yellow (Y) toner image, a forming device 20M that forms a magenta (M) toner image, a forming device 20C that forms a cyan (C) toner image, and a forming device 20K that forms a black (K) toner image. Hereinafter, if there is no need to distinguish the forming devices 20 from one another by their colors, the suffixes Y, M, C, and K are omitted.

The plural forming devices 20, the fixing device 40, the delivering device 60, and the supplying device 70 are joinable to one another and are arranged at respective positions on a transport path 12 along which the sheet member P is transported.

The transport path 12 has a U shape when seen in the width direction of the sheet member P that is being transported (the width direction corresponds to the apparatus depth direction in the first exemplary embodiment). Specifically, the transport path 12 extends from a first side (the left side in FIG. 1) toward a second side (the right side in FIG. 1) in the apparatus width direction, turns around by 180 degrees in the delivering device 60, and further extends from the second side toward the first side in the apparatus width direction.

The supplying device 70, the forming device 20Y, the forming device 20M, the delivering device 60, the forming device 20C, the forming device 20K, and the fixing device 40 are arranged in this order from the upstream side in the direction of transport of the sheet member P (hereinafter referred to as "sheet transporting direction").

Forming Device

Figure 2B:
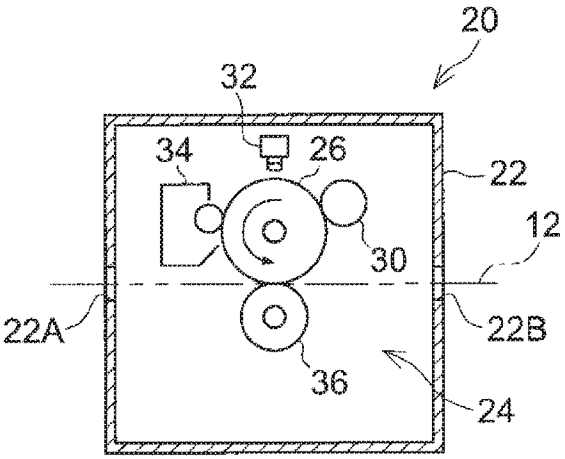
Figure 3:
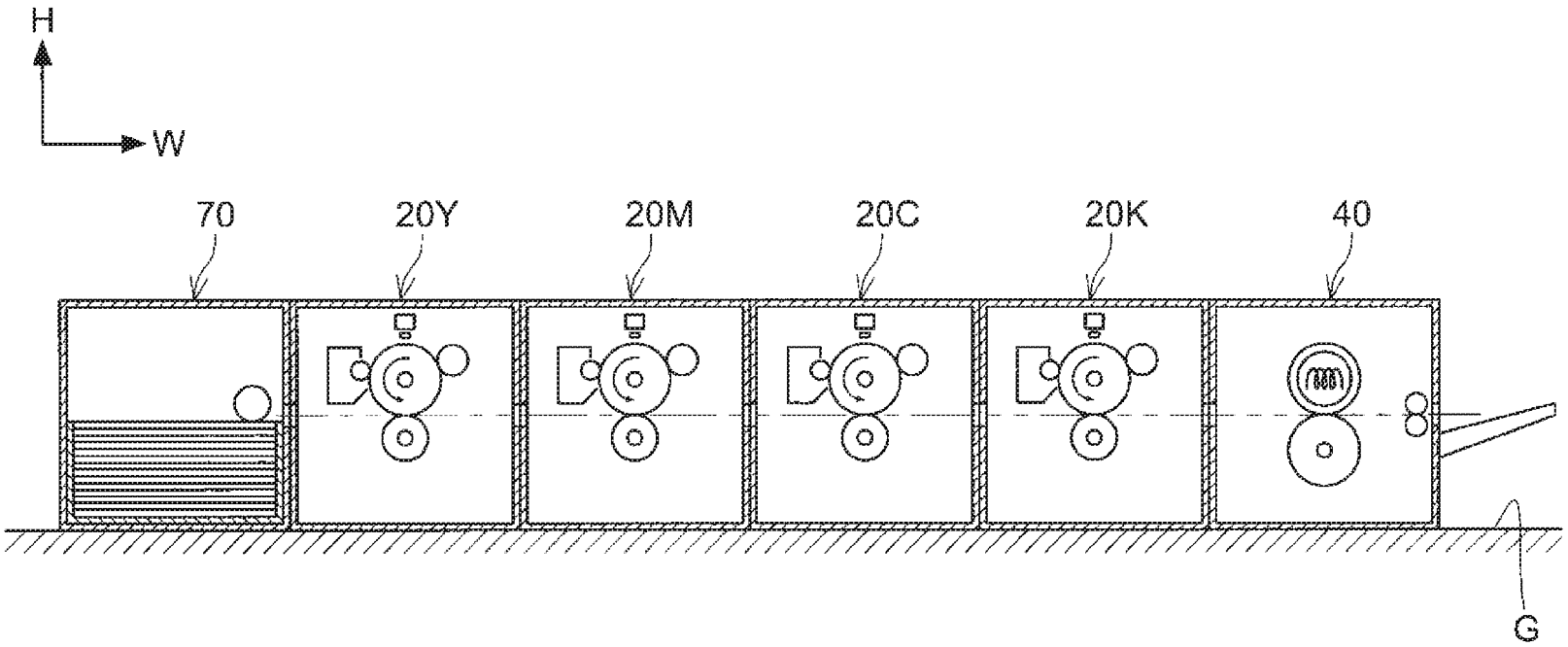
FIG. 3 is a schematic diagram of an image forming apparatus according to a comparative embodiment with respect to the image forming apparatus according to the first exemplary embodiment of the present invention.

Referring to FIG. 2B, the forming devices 20 each include a first housing 22 and a forming unit 24 provided in the first housing 22.

The first housing 22 has a rectangular shape when seen in the width direction of the sheet member P that is being transported. The first housing 22 has an inlet 22A and an outlet 22B through which the sheet member P passes. The inlet 22A and the outlet 22B are provided at respective positions on a straight or substantially straight virtual line when seen in the width direction of the sheet member P that is being transported. Such a configuration allows plural first housings 22 to be joined to one another such that the outlet 22B of one first housing 22 faces the inlet 22A of another first housing 22. In such a state, the sheet member P is allowed to be passed from the one first housing 22 to the other first housing 22.

Referring to FIG. 1 illustrating the first exemplary embodiment, when seen in the width direction of the sheet member P that is being transported, the outlet 22B of the first housing 22 of the forming device 20Y faces the inlet 22A of the first housing 22 of the forming device 20M while the outlet 22B of the first housing 22 of the forming device 20C faces the inlet 22A of the first housing 22 of the forming device 20K.

Referring to FIG. 2B, the forming units 24 for the respective colors each include an image carrier 26, a charging roller 30 that charges the surface of the image carrier 26, an exposure unit 32 that applies exposure light to the charged image carrier 26 and thus forms an electrostatic latent image on the image carrier 26, a developing device 34 that develops the electrostatic latent image formed by the exposure unit 32 and thus visualizes the electrostatic latent image as a toner image, and a transfer roller 36 that transfers the toner image to the sheet member P transported thereto.

The image carrier 26 has a columnar shape and rotates when driven. The transfer roller 36 is provided across the transport path 12 from the image carrier 26. The transfer roller 36 is in contact with the image carrier 26 and rotates by following the rotation of the image carrier 26.

In such a configuration, the sheet member P taken into the inlet 22A is received by the image carrier 26 that is rotating, and is transported while being nipped between the image carrier 26 and the transfer roller 36. Thus, the toner image is transferred to the sheet member P. The image carrier 26 that is rotating discharges the sheet member P now having the toner image from the outlet 22B.

Referring to FIG. 1, the forming device 20C and the forming device 20K are oriented upside down with respect to the forming device 20Y and the forming device 20M.

Fixing Device

Figure 2C:
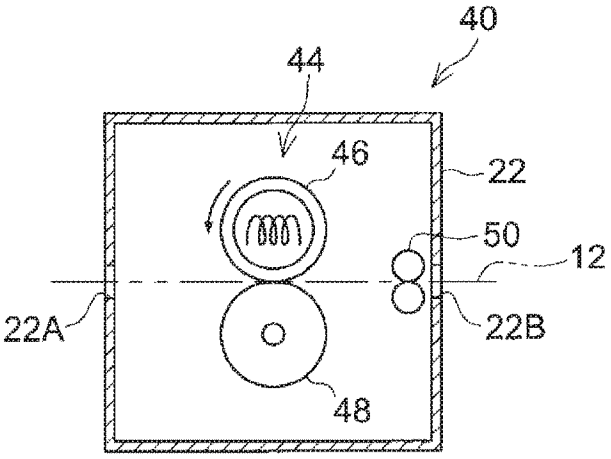

Referring to FIG. 2C, the fixing device 40 includes a first housing 22 and a fixing unit 44 provided in the first housing 22.

The fixing unit 44 includes a heating roller 46 that heats the sheet member P, a pressing roller 48 that presses the sheet member P toward the heating roller 46, and a pair of transporting rollers 50 that discharge the sheet member P to the outside of the first housing 22 while being driven to rotate. The heating roller 46 rotates when driven. The pressing roller 48 is provided across the transport path 12 from the heating roller 46. The pressing roller 48 is in contact with the heating roller 46 and rotates by following the rotation of the heating roller 46.

Referring to FIG. 1 illustrating the first exemplary embodiment, when seen in the width direction of the sheet member P that is being transported, the outlet 22B of the first housing 22 of the forming device 20K faces the inlet 22A of the first housing 22 of the fixing device 40. When seen in the width direction of the sheet member P that is being transported, the inlet 22A and the outlet 22B are provided at respective positions on a straight or substantially straight virtual line. Such a configuration allows the plural first housings 22 to be joined to one another such that the outlet 22B of one first housing 22 faces the inlet 22A of another first housing 22.

In such a configuration, the sheet member P taken into the inlet 22A is received by the heating roller 46 that is rotating, and is transported while being nipped between the heating roller 46 and the pressing roller 48. Thus, the toner image on the sheet member P is fixed by the fixing unit 44. Furthermore, the pair of transporting rollers 50 that are rotating discharge the sheet member P now having the fixed toner image from the outlet 22B.

Delivering Device

Referring to FIG. 1, the delivering device 60 includes a second housing 62 and a delivering unit 64 provided in the second housing 62.

When seen in the width direction of the sheet member P, the second housing 62 has an oblong rectangular shape extending in the apparatus top-bottom direction, equivalent to a combination of two first housings 22 that are stacked one on top of another. The second housing 62 has an inlet 62A and an outlet 62B through which the sheet member P passes.

The inlet 62A is provided on the first side in the apparatus width direction so that the sheet member P transported from the first side toward the other side (in an exemplary first direction) in the apparatus width direction is taken thereinto. The outlet 62B is provided on the upper side with respect to the inlet 62A and on the first side in the apparatus width direction so that the sheet member P is discharged from the second side toward the first side (in an exemplary second direction) in the apparatus width direction.

The second housing 62 is joinable to any of the first housings 22 such that the inlet 62A thereof faces the outlet 22B of one first housing 22 while the outlet 62B thereof faces the inlet 22A of another first housing 22. In the first exemplary embodiment, when seen in the width direction of the sheet member P, the second housing 62 is positioned such that the inlet 62A thereof faces the outlet 22B of the first housing 22 of the forming device 20M while the outlet 62B thereof faces the inlet 22A of the first housing 22 of the forming device 20C.

The delivering unit 64 includes a pair of transporting rollers 66A that receive the sheet member P taken into the inlet 62A while being driven to rotate, a pair of transporting rollers 66B that discharge the sheet member P from the outlet 62B while being driven to rotate, and a pair of transporting rollers 66C provided between the pair of transporting rollers 66A and the pair of transporting rollers 66B.

The delivering unit 64 further includes a guide member 68 that guides the sheet member P transported into the delivering unit 64 and coming into contact therewith. The guide member 68 changes the sheet transporting direction. Specifically, the sheet member P transported from the first side toward the second side in the apparatus width direction is redirected by the guide member 68 in such a manner as to be transported from the second side toward the first side in the apparatus width direction.

In such a configuration, the sheet member P transported from the first side toward the second side in the apparatus width direction and taken into the inlet 62A is received by the pair of transporting rollers 66A that are rotating. The sheet member P then comes into contact with the guide member 68 and is guided along the guide member 68. Thus, the sheet transporting direction is changed by 180 degrees. Then, the pair of transporting rollers 66B that are rotating discharge the sheet member P through the outlet 62B from the second side toward the first side in the apparatus width direction.

Supplying Device

Referring to FIG. 2A, the supplying device 70 includes a third housing 72 and a supplying unit 74 provided in the third housing 72.

When seen in the width direction of the sheet member P, the third housing 72 has the same rectangular shape as the first housing 22. The third housing 72 has an outlet 72B through which the sheet member P passes. The third housing 72 is joinable to any of the first housings 22 or to the second housing 62 such that the outlet 72B thereof faces the inlet 22A of the first housing 22 or the inlet 62A of the second housing 62 (see FIG. 1). In the first exemplary embodiment illustrated in FIG. 1, when seen in the width direction of the sheet member P, the third housing 72 is positioned such that the outlet 72B thereof faces the inlet 22A of the first housing 22 of the forming device 20Y.

Referring to FIG. 2A, the supplying unit 74 includes a sheet cassette 76 in which sheet members P are stacked, and a transport roller 78 that discharges one of the sheet members P stacked in the sheet cassette 76 to the outside from the outlet 72B.

The fixing device 40, the forming device 20K, and the forming device 20C are positioned on top of the supplying device 70, the forming device 20Y, and the forming device 20M, respectively. The supplying device 70, the forming device 20Y, and the forming device 20M form an upstream portion of the transport path 12 having a U shape. The fixing device 40, the forming device 20K, and the forming device 20C form a downstream portion of the transport path 12 having a U shape.

Functions

The supplying device 70 discharges a sheet member P through the outlet 72B from the first side toward the second side in the apparatus width direction (see FIG. 1).

The forming device 20Y and the forming device 20M form yellow (Y) and magenta (M) toner images, respectively, on the sheet member P while transporting the sheet member P from the first side toward the second side in the apparatus width direction.

The delivering device 60 receives the sheet member P transported from the first side toward the second side in the apparatus width direction and discharges the sheet member P from the second side toward the first side in the apparatus width direction.

The forming device 20C and the forming device 20K form cyan (C) and black (K) toner images, respectively, on the sheet member P while transporting the sheet member P from the second side toward the first side in the apparatus width direction.

The fixing device 40 fixes the toner images in the respective colors on the sheet member P while transporting the sheet member P from the second side toward the first side in the apparatus width direction and discharges the sheet member P now having the fixed toner images to the outside.

SUMMARY

As described above, the delivering device 60 receives the sheet member P that is transported from the first side toward the second side in the apparatus width direction and discharges the received sheet member P from the second side toward the first side in the apparatus width direction. Hence, the image forming apparatus 10 has a shorter length in the apparatus width direction than an image forming apparatus (see FIG. 3) including plural devices that are arranged in a line extending in the apparatus width direction (the first direction).

Furthermore, the first housings 22 are joinable to one another such that the outlet 22B of one first housing 22 faces the inlet 22A of another first housing 22. Furthermore, the second housing 62 is joinable to any of the first housings 22 such that the inlet 62A thereof faces the outlet 22B of one first housing 22 while the outlet 62B thereof faces the inlet 22A of another first housing 22. Furthermore, the third housing 72 is joinable to any of the first housings 22 or the second housing 62 such that the outlet 72B thereof faces the inlet 22A of one first housing 22 or the inlet 62A of the second housing 62. That is, the housings 22, 62, and 72 are joinable to one another in accordance with the shape of the floor surface G on which the image forming apparatus 10 is to be installed.

Second Exemplary Embodiment

An image forming apparatus according to a second exemplary embodiment of the present invention will now be described with reference to FIG. 4, focusing on differences from the first exemplary embodiment, basically.

Figure 4:
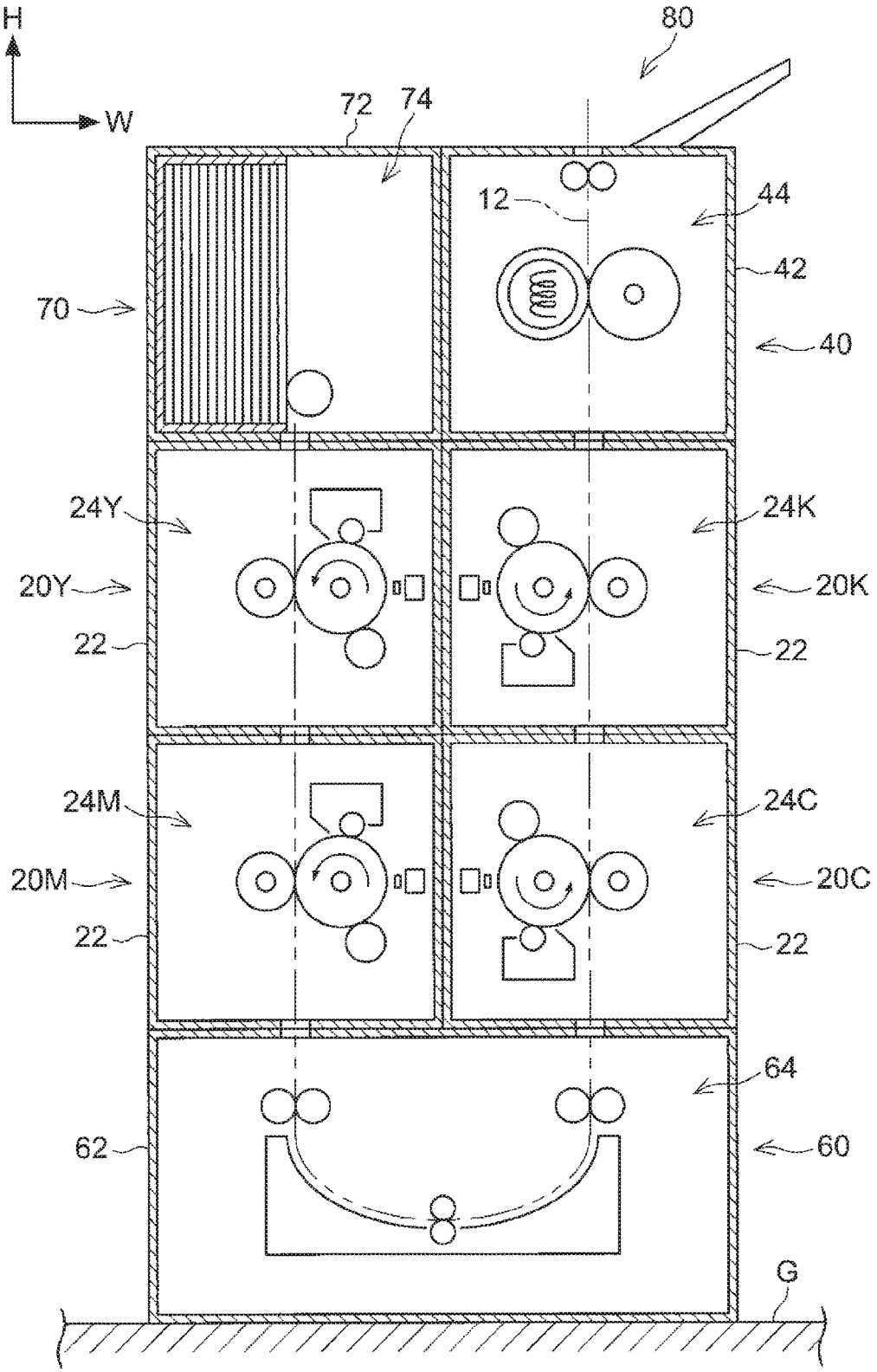
FIG. 4 is a schematic diagram of an image forming apparatus according to a second exemplary embodiment of the present invention.

Referring to FIG. 4, an image forming apparatus 80 according to the second exemplary embodiment is obtained by turning the image forming apparatus 10 according to the first exemplary embodiment by 90 degrees around an axis extending in the apparatus depth direction.

Specifically, a supplying device 70, a forming device 20Y, a forming device 20M, and a delivering device 60 are stacked in this order from the upper side toward the lower side in the apparatus top-bottom direction, and the delivering device 60, a forming device 20C, a forming device 20K, and a fixing device 40 are stacked in this order from the lower side toward the upper side in the apparatus top-bottom direction. The forming device 20C, the forming device 20K, and the fixing device 40 are positioned side by side with the forming device 20M, the forming device 20Y, and the supplying device 70, respectively, in the apparatus width direction.

As described above, the arrangement of the devices included in the image forming apparatus is determinable in accordance with the shape of the floor surface G on which the image forming apparatus is to be installed.

The other functions realized in the second exemplary embodiment are the same as those realized in the first exemplary embodiment.

Third Exemplary Embodiment

An image forming apparatus according to a third exemplary embodiment of the present invention will now be described with reference to FIG. 5, focusing on differences from the first exemplary embodiment, basically.

Figure 5:
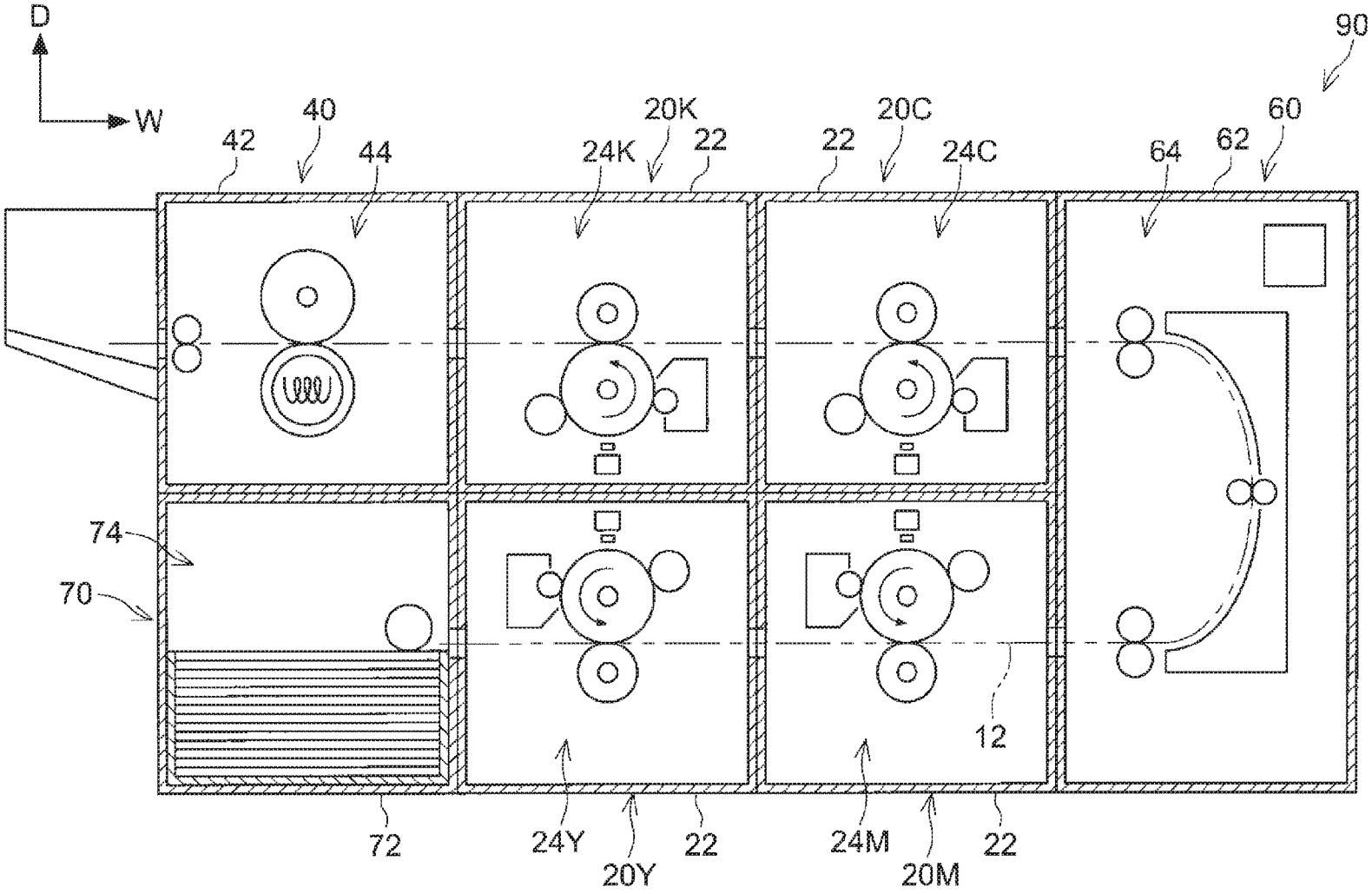
FIG. 5 is a schematic diagram of an image forming apparatus according to a third exemplary embodiment of the present invention.

Referring to FIG. 5, an image forming apparatus 90 according to the third exemplary embodiment is obtained by turning the image forming apparatus 10 according to the first exemplary embodiment by 90 degrees around an axis extending in the apparatus width direction.

Specifically, a supplying device 70, a forming device 20Y, a forming device 20M, and a delivering device 60 are arranged in this order from the first side toward the second side in the apparatus width direction, while the delivering device 60, a forming device 20C, a forming device 20K, and a fixing device 40 are arranged in this order from the second side toward the first side in the apparatus width direction. In the apparatus depth direction, the forming device 20C, the forming device 20K, and the fixing device 40 are positioned next to the forming device 20M, the forming device 20Y, and the supplying device 70, respectively.

The other functions realized in the third exemplary embodiment are the same as those realized in the first exemplary embodiment.

Fourth Exemplary Embodiment

An image forming apparatus according to a fourth exemplary embodiment of the present invention will now be described with reference to FIG. 6, focusing on differences from the first exemplary embodiment, basically.

Figure 6:
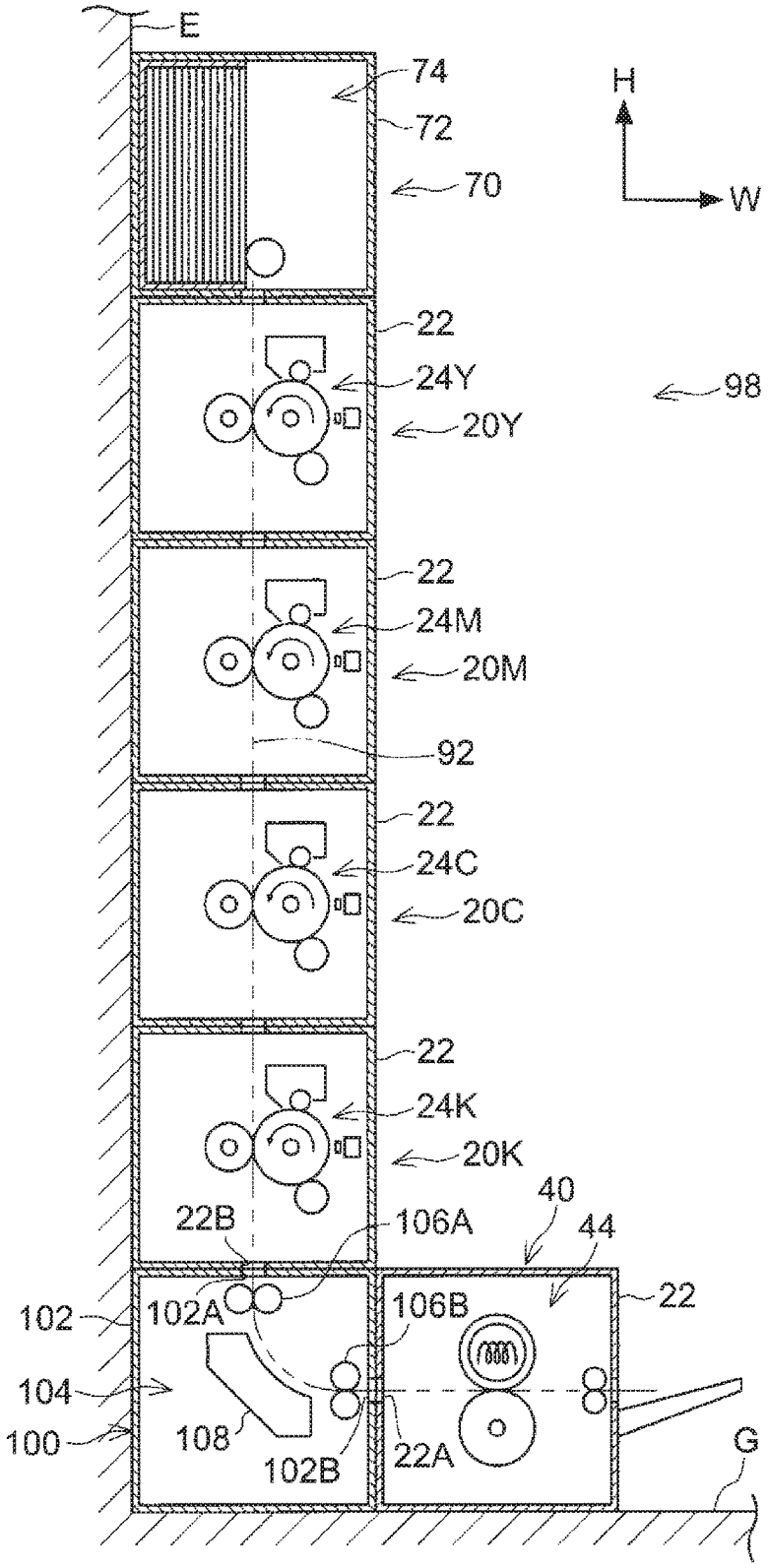
FIG. 6 is a schematic diagram of an image forming apparatus according to a fourth exemplary embodiment of the present invention.

Referring to FIG. 6, an image forming apparatus 98 according to the fourth exemplary embodiment has a transport path 92 along which the sheet member P is transported. The transport path 92 extends in an L shape when seen in the width direction of the sheet member P.

A supplying device 70, a forming device 20Y, a forming device 20M, a forming device 20C, and a forming device 20K are arranged in this order along a wall E from the upper side toward the lower side in the apparatus top-bottom direction. Furthermore, a delivering device 100 is provided under the forming device 20K, and a fixing device 40 is provided on the second side of the delivering device 100 in the apparatus width direction.

Delivering Device

The delivering device 100 includes a second housing 102 and a delivering unit 104 provided in the second housing 102.

The second housing 102 has the same rectangular shape as the first housing 22 when seen in the width direction of the sheet member P. The second housing 102 has an inlet 102A and an outlet 102B through which the sheet member P passes.

The inlet 102A is provided on the upper side of the second housing 102 in the apparatus top-bottom direction so that the sheet member P transported from the upper side toward the lower side (in an exemplary first direction) in the apparatus top-bottom direction is received. The outlet 102B is provided on the second side of the second housing 102 in the apparatus width direction so that the sheet member P is discharged from the first side toward the second side (in an exemplary second direction) in the apparatus width direction.

Hence, the second housing 102 is joinable to any of the first housings 22 such that the inlet 102A thereof faces the outlet 22B of one first housing 22 while the outlet 102B thereof faces the inlet 22A of another first housing 22. In the fourth exemplary embodiment, the second housing 102 is positioned such that the inlet 102A thereof faces the outlet 22B of the first housing 22 of the forming device 20K while the outlet 102B thereof faces the inlet 22A of the first housing 22 of the fixing device 40.

The delivering unit 104 includes a pair of transporting rollers 106A that receive the sheet member P taken into the inlet 102A while being driven to rotate, a pair of transporting rollers 106B that discharge the sheet member P from the outlet 102B while being driven to rotate, and a guide member 108 that guides the sheet member P coming into contact therewith and changes the sheet transporting direction. Specifically, the guide member 108 guides the sheet member P such that the sheet member P transported from the upper side toward the lower side in the apparatus top-bottom direction is transported from the first side toward the second side in the apparatus width direction.

In such a configuration, the pair of transporting rollers 106A that are rotating receive the sheet member P taken into the inlet 102A and transported from the upper side toward the lower side in the apparatus top-bottom direction. Then, the guide member 108 receives the sheet member P coming into contact therewith and guides the sheet member P therealong, whereby the sheet transporting direction is changed by 90 degrees. The pair of transporting rollers 106B that are rotating discharge the sheet member P through the outlet 102B from the first side toward the second side in the apparatus width direction.

Functions

The supplying device 70 discharges the sheet member P through the outlet 72B from the upper side toward the lower side in the apparatus top-bottom direction.

Then, the forming device 20Y, the forming device 20M, the forming device 20C, and the forming device 20K form yellow (Y), magenta (M), cyan (C), and black (K) toner images, respectively, on the sheet member P while transporting the sheet member P in from the upper side toward the lower side in the apparatus top-bottom direction.

The delivering device 100 receives the sheet member P transported from the upper side toward the lower side in the apparatus top-bottom direction and discharges the sheet member P from the first side toward the second side in the apparatus width direction.

The fixing device 40 fixes the toner images in the respective colors on the sheet member P while transporting the sheet member P from the first side toward the second side in the apparatus width direction, and discharges the sheet member P now having the fixed toner images to the outside.

The other functions realized in the fourth exemplary embodiment are the same as those realized in the first exemplary embodiment.

Fifth Exemplary Embodiment

An image forming apparatus according to a fifth exemplary embodiment of the present invention will now be described with reference to FIG. 7, focusing on differences from the fourth exemplary embodiment, basically.

Figure 7:
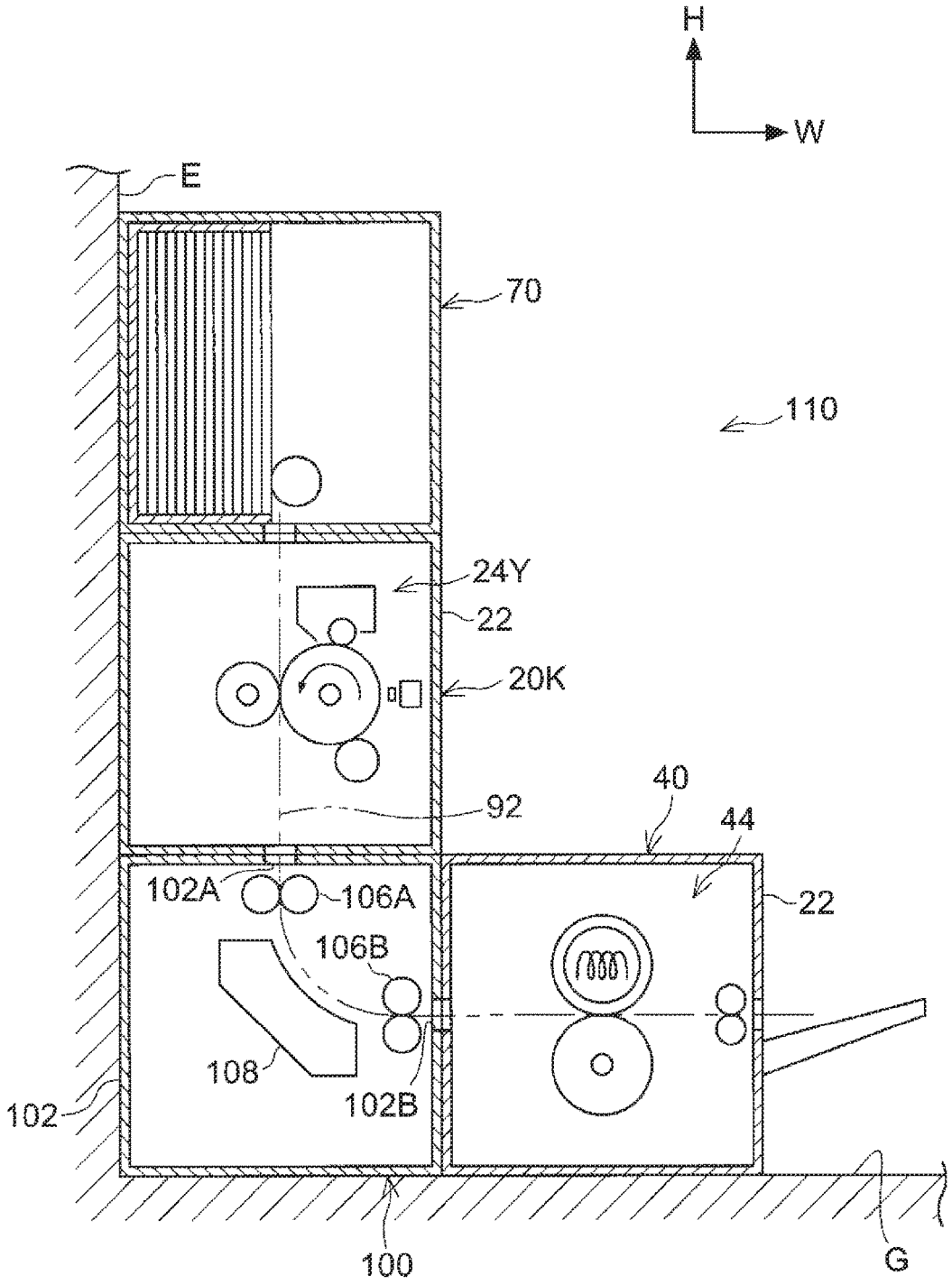
FIG. 7 is a schematic diagram of an image forming apparatus according to a fifth exemplary embodiment of the present invention.

Referring to FIG. 7, an image forming apparatus 110 according to the fifth exemplary embodiment includes a supplying device 70 and a forming device 20K arranged in this order along a wall E from the upper side toward the lower side in the apparatus top-bottom direction.

The image forming apparatus 110 configured as above forms only a black (K) toner image on the sheet member P.

The other functions realized in the fifth exemplary embodiment are the same as those realized in the fourth exemplary embodiment.

Sixth Exemplary Embodiment

An image forming apparatus according to a sixth exemplary embodiment of the present invention will now be described with reference to FIG. 8, focusing on differences from the first exemplary embodiment, basically.

Configuration

Figure 8:
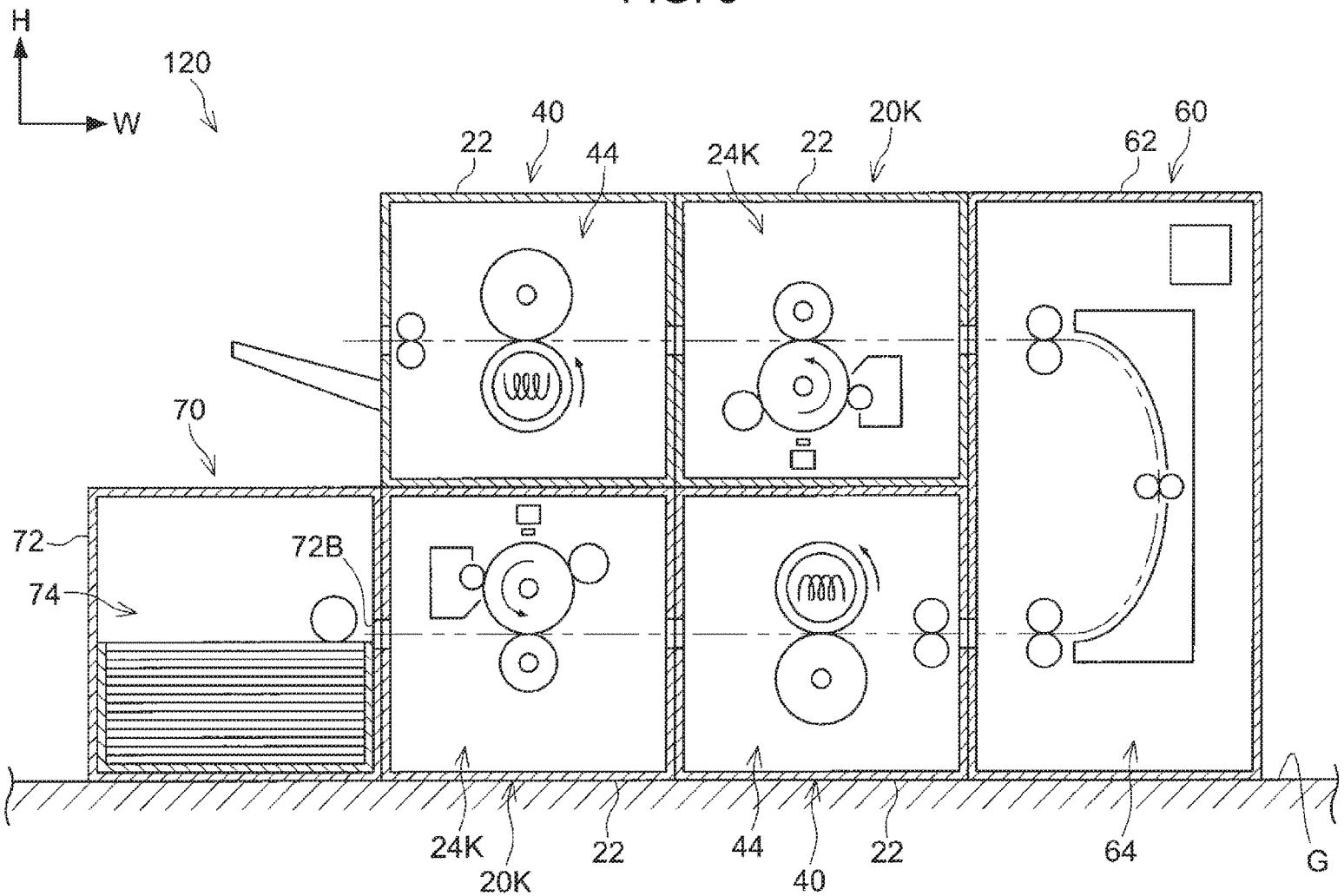
FIG. 8 is a schematic diagram of an image forming apparatus according to a sixth exemplary embodiment of the present invention.

Referring to FIG. 8, an image forming apparatus 120 according to the sixth exemplary embodiment includes a supplying device 70, a forming device 20K, a fixing device 40, a delivering device 60, another forming device 20K, and another fixing device 40 arranged in this order from the upstream side in the sheet transporting direction.

The fixing device 40 and the forming device 20K that are on the downstream side in the sheet transporting direction are positioned on top of the forming device 20K and the fixing device 40, respectively, that are on the upstream side in the sheet transporting direction. The forming device 20K on the downstream side in the sheet transporting direction forms a toner image on a second surface of the sheet member P that is opposite a first surface of the sheet member P on which the forming device 20K on the upstream side in the sheet transporting direction forms a toner image.

The fixing device 40 on the upstream side in the sheet transporting direction heats the first surface of the sheet member P, while the fixing device 40 on the downstream side in the sheet transporting direction heats the second surface of the sheet member P.

Functions

The supplying device 70 discharges a sheet member P through the outlet 72B from the first side toward the second side in the apparatus width direction.

The forming device 20K on the upstream side forms a black (K) toner image on the first surface of the sheet member P while transporting the sheet member P from the first side toward the second side in the apparatus width direction.

The fixing device 40 on the upstream side receives the sheet member P now having the toner image on the first side thereof and fixes the toner image on the sheet member P while transporting the sheet member P from the first side toward the second side in the apparatus width direction.

The delivering device 60 receives the sheet member P transported from the first side toward the second side in the apparatus width direction and discharges the sheet member P from the second side toward the first side in the apparatus width direction.

The forming device 20K on the downstream side receives the sheet member P from the delivering device 60 and forms a black (K) toner image on the second surface of the sheet member P while transporting the sheet member P from the second side toward the first side in the apparatus width direction.

The fixing device 40 on the downstream side receives the sheet member P now having the toner image on the second side as well and fixes the toner image on the sheet member P while transporting the sheet member P from the second side toward the first side in the apparatus width direction. Thus, the image forming apparatus 120 forms toner images on both sides of the sheet member P.

The other functions realized in the sixth exemplary embodiment are the same as those realized in the fourth exemplary embodiment.

While some specific exemplary embodiments of the present invention have been described in detail, the present invention is not limited to such exemplary embodiments. It is obvious for those skilled in the art that various other exemplary embodiments are conceivable within the scope of the present invention. For example, the supplying device 70, the forming devices 20, the delivering device 60 or 100, and the fixing device 40 may be joined to one another in any other ways that have not been employed in the above exemplary embodiments.

While the above exemplary embodiments each concern a case where the sheet transporting direction is changed by 180 degrees by using the delivering device 60 or by 90 degrees by using the delivering device 100, the sheet transporting direction may be changed by 180 degrees by using two delivering devices 100, for example.

While the above exemplary embodiments each concern the case where the sheet transporting direction is changed by 180 degrees by using the delivering device 60 or by 90 degrees by using the delivering device 100, the sheet transporting direction may be changed by any other angle that is different from 180 degrees and 90 degrees, for example.

Although not especially mentioned in the above exemplary embodiments, a postprocessing device such as a binding unit may be provided at the most downstream position in the sheet transporting direction. That is, a postprocessing device may be provided on the downstream side of the fixing device 40 in the sheet transporting direction.

First Reference Embodiment

An image forming apparatus according to a first reference embodiment of the present invention will now be described with reference to FIG. 9, focusing on differences from the first exemplary embodiment, basically.

Figure 9:
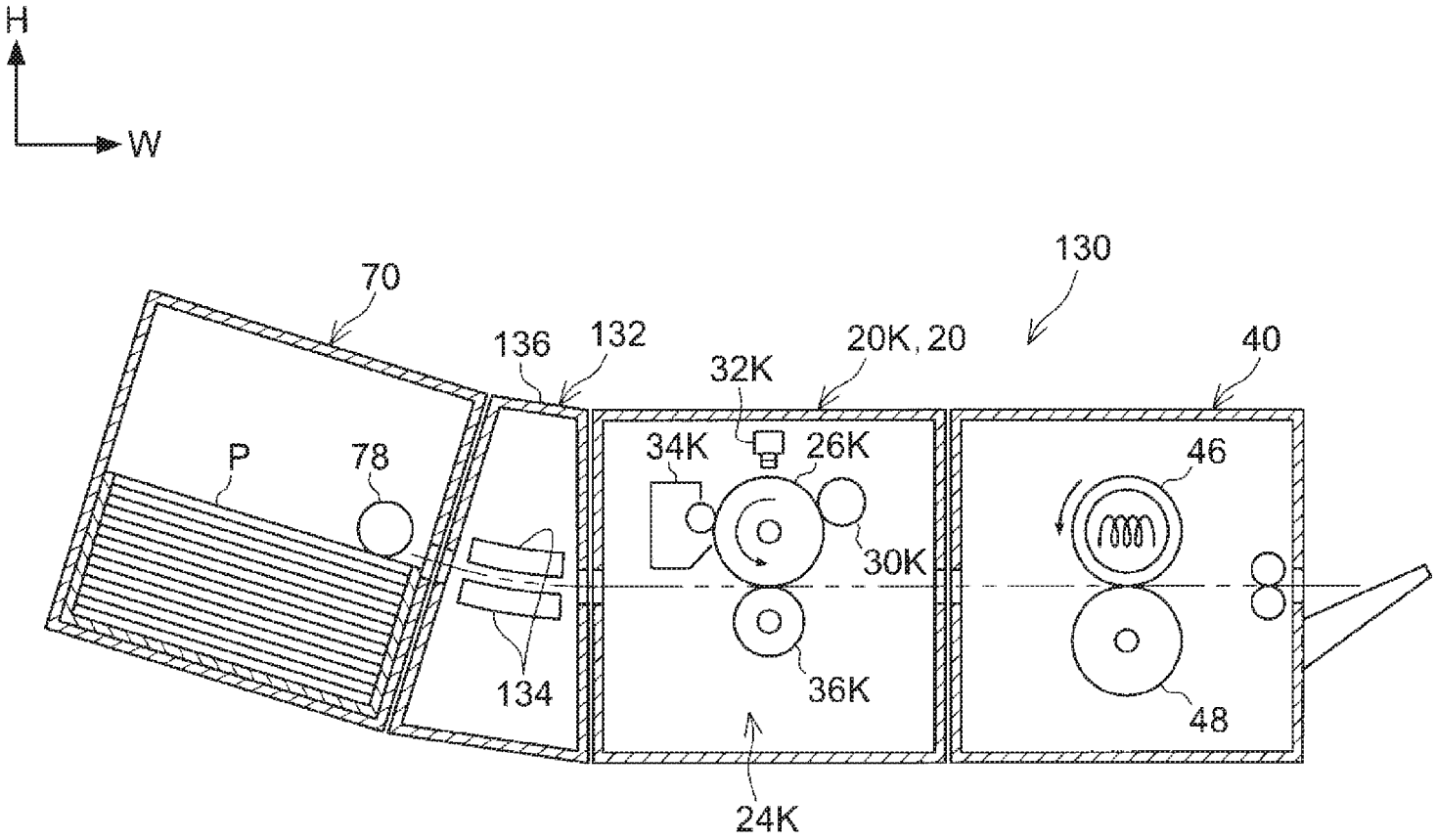
FIG. 9 is a schematic diagram of an image forming apparatus according to a first reference embodiment of the present invention.

Referring to FIG. 9, an image forming apparatus 130 according to the first reference embodiment includes a supplying device 70, a delivering device 132, a forming device 20K, and a fixing device 40 that are arranged in this order in the apparatus width direction.

The delivering device 132 includes a housing 136 and guiding plates 134 provided in the housing 136. The delivering device 132 changes the direction of transport of the sheet member P received from the supplying device 70.

Second Reference Embodiment

An image forming apparatus according to a second reference embodiment of the present invention will now be described with reference to FIG. 10, focusing on differences from the first reference embodiment, basically.

Figure 10:
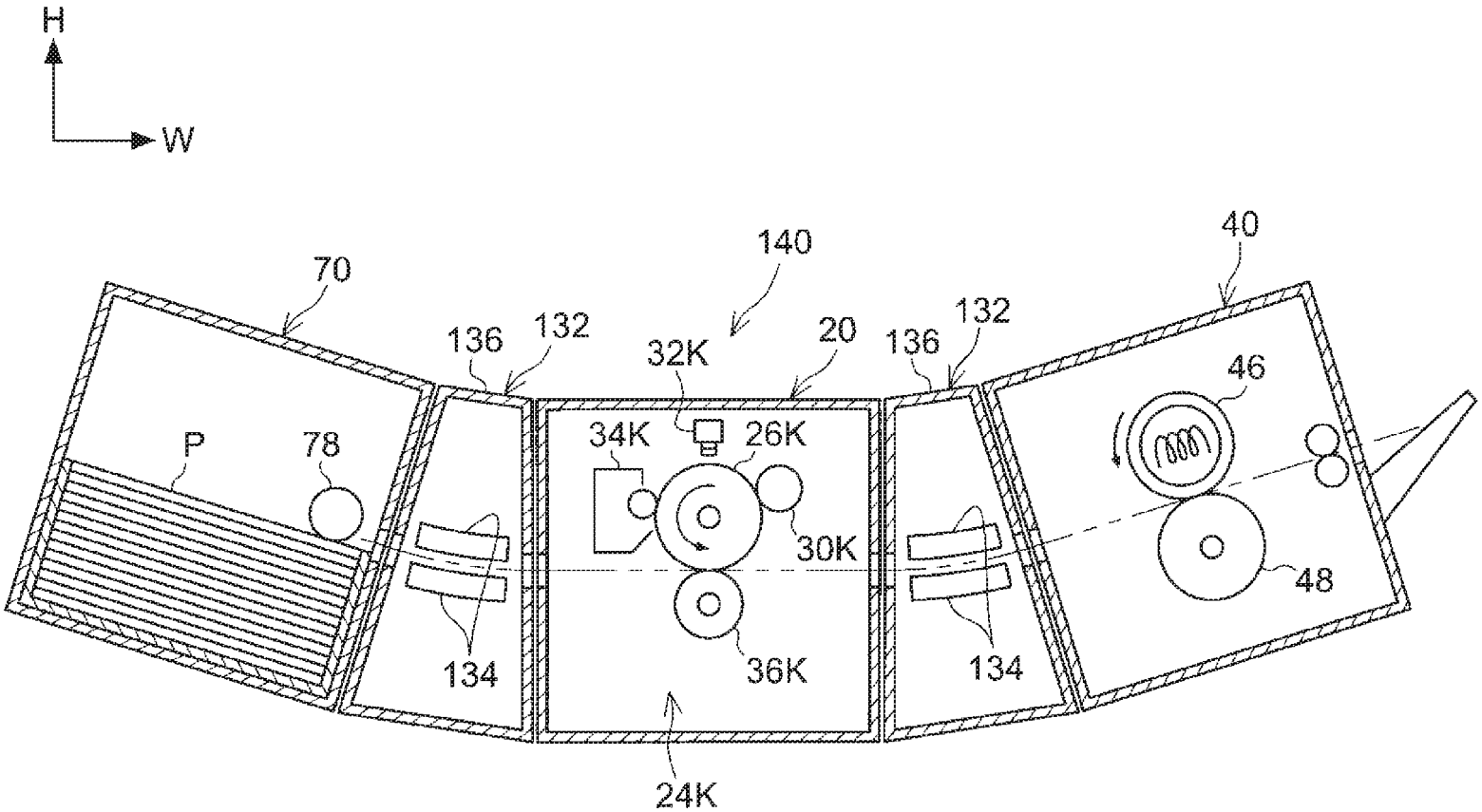
FIG. 10 is a schematic diagram of an image forming apparatus according to a second reference embodiment of the present invention.

Referring to FIG. 10, an image forming apparatus 140 according to the second reference embodiment includes a supplying device 70, a delivering device 132, a forming device 20K, another delivering device 132, and a fixing device 40 that are arranged in this order in the apparatus width direction.

Third Reference Embodiment

An image forming apparatus according to a third reference embodiment of the present invention will now be described with reference to FIG. 11, focusing on differences from the first reference embodiment, basically.

Figure 11:
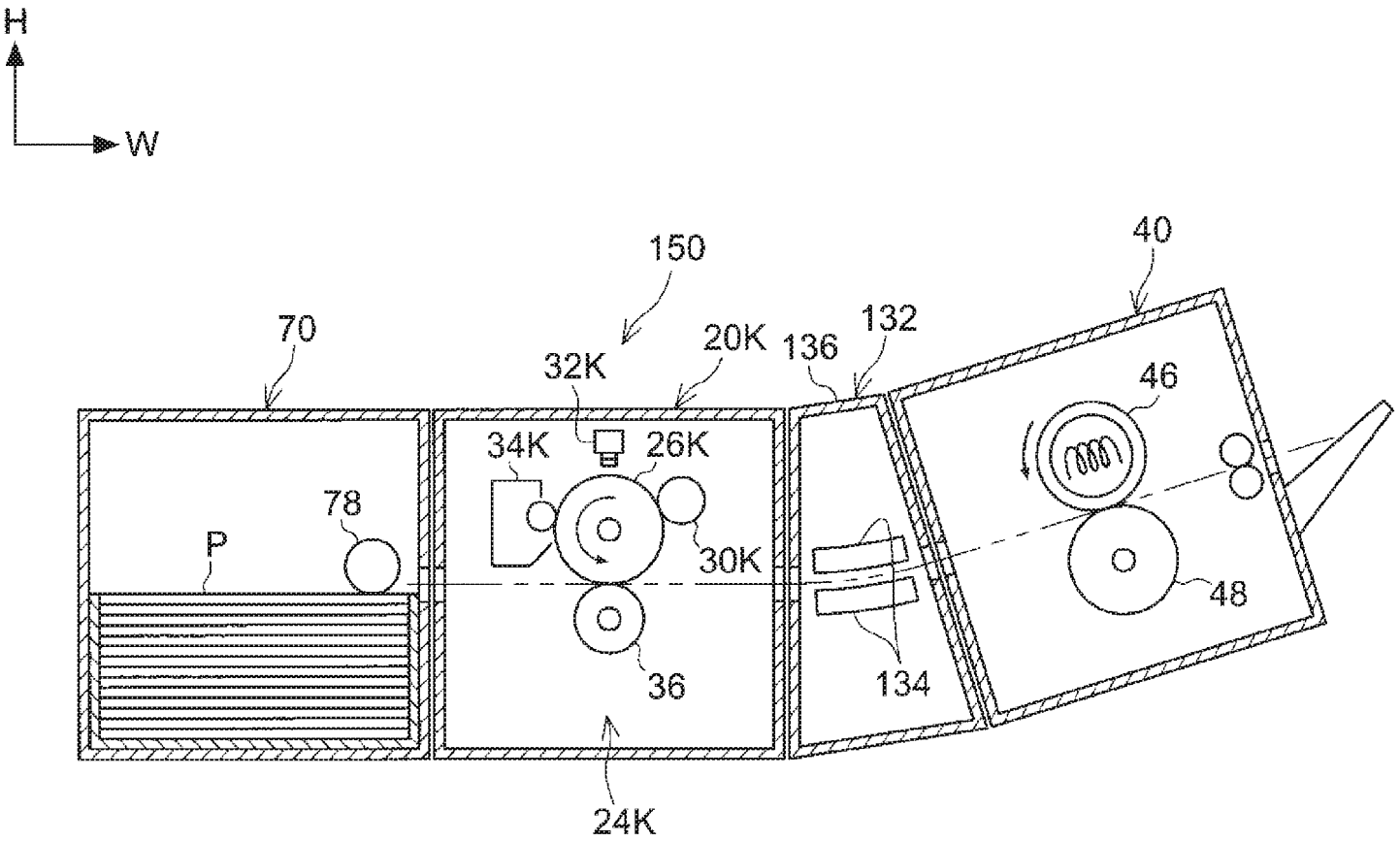
FIG. 11 is a schematic diagram of an image forming apparatus according to a third reference embodiment of the present invention.

Referring to FIG. 11, an image forming apparatus 150 according to the third reference embodiment includes a supplying device 70, a forming device 20K, a delivering device 132, and a fixing device 40 that are arranged in this order in the apparatus width direction.

Fourth Reference Embodiment

An image forming apparatus according to a fourth reference embodiment of the present invention will now be described with reference to FIG. 12, focusing on differences from the second reference embodiment, basically.

Figure 12:
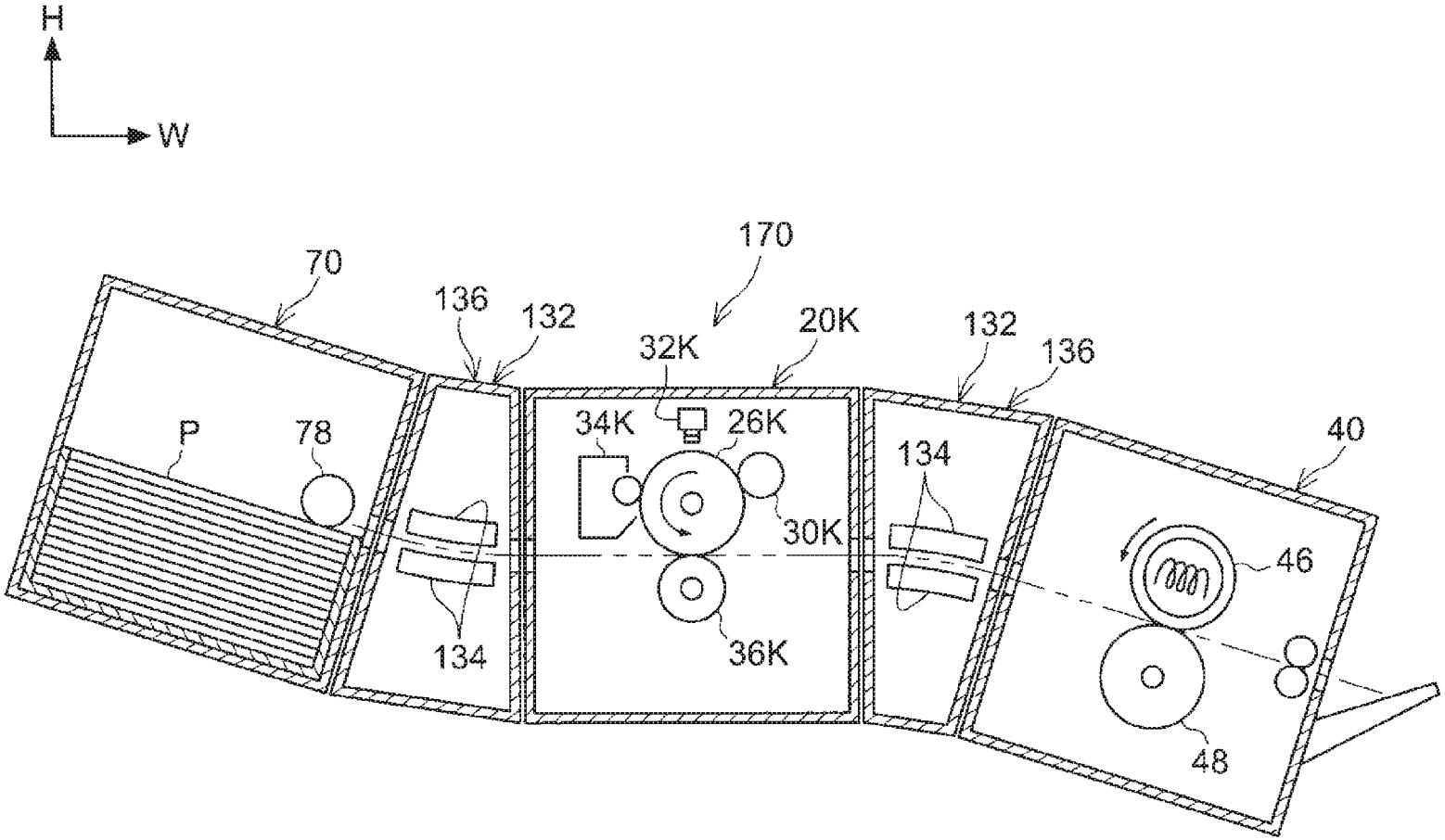
FIG. 12 is a schematic diagram of an image forming apparatus according to a fourth reference embodiment of the present invention.

Referring to FIG. 12, an image forming apparatus 170 according to the fourth reference embodiment includes a supplying device 70, a delivering device 132, a forming device 20K, another delivering device 132, and a fixing device 40 that are arranged in this order in the apparatus width direction. The delivering device 132 provided between the forming device 20K and the fixing device 40 is oriented upside down with respect to the delivering device 132 provided between the supplying device 70 and the forming device 20K.

Fifth Reference Embodiment

An image forming apparatus according to a fifth reference embodiment of the present invention will now be described with reference to FIG. 13, focusing on differences from the second reference embodiment, basically.

Figure 13:
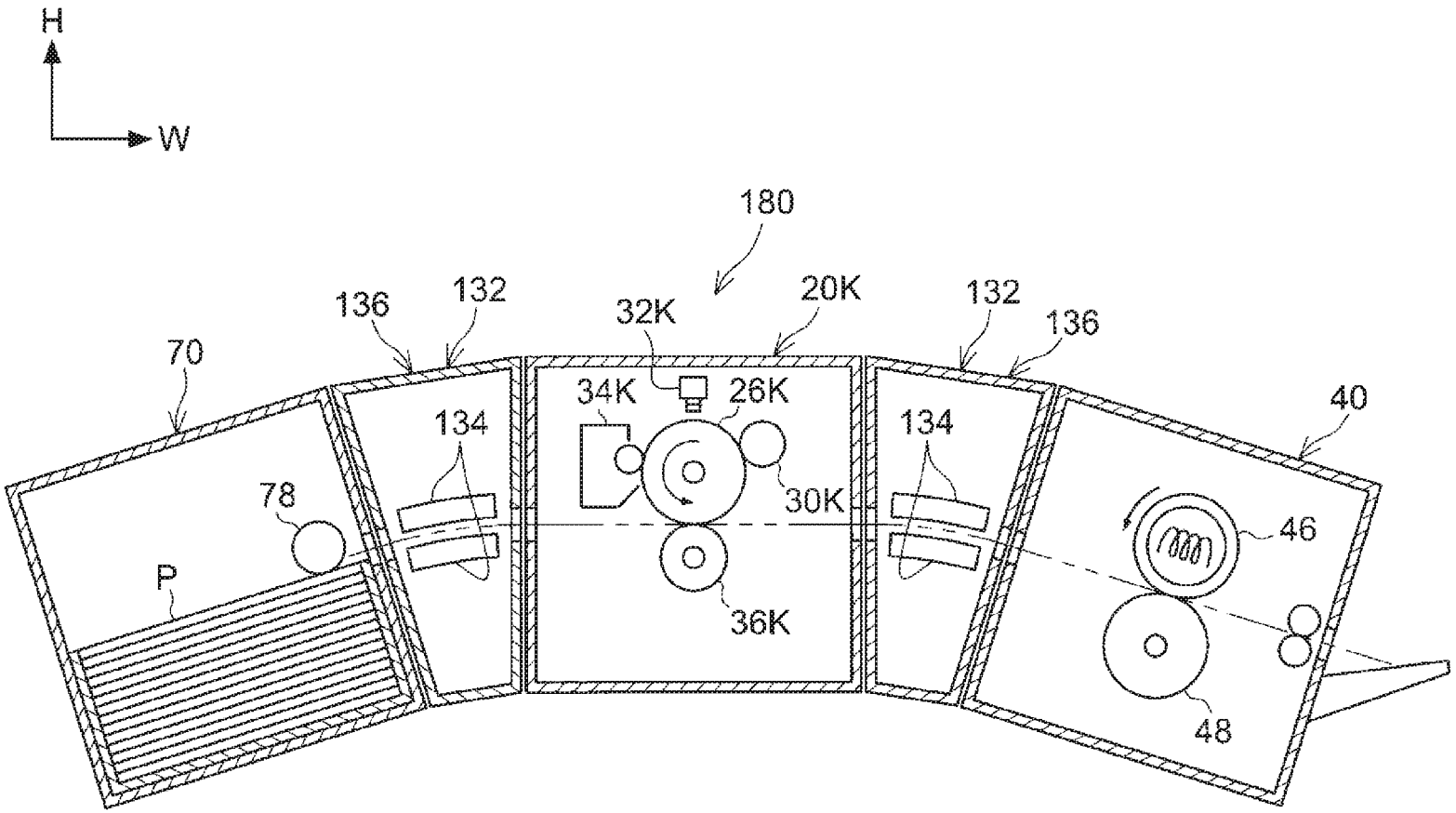
FIG. 13 is a schematic diagram of an image forming apparatus according to a fifth reference embodiment of the present invention.

Referring to FIG. 13, an image forming apparatus 180 according to the fifth reference embodiment includes a supplying device 70, a delivering device 132, a forming device 20K, another delivering device 132, and a fixing device 40 that are arranged in this order in the apparatus width direction. The two delivering devices 132 are oriented upside down with respect to the delivering devices 132 according to the second reference embodiment (see FIG. 10).

Sixth Reference Embodiment

An image forming apparatus according to a sixth reference embodiment of the present invention will now be described with reference to FIG. 14, focusing on differences from the first reference embodiment, basically.

Figure 14:
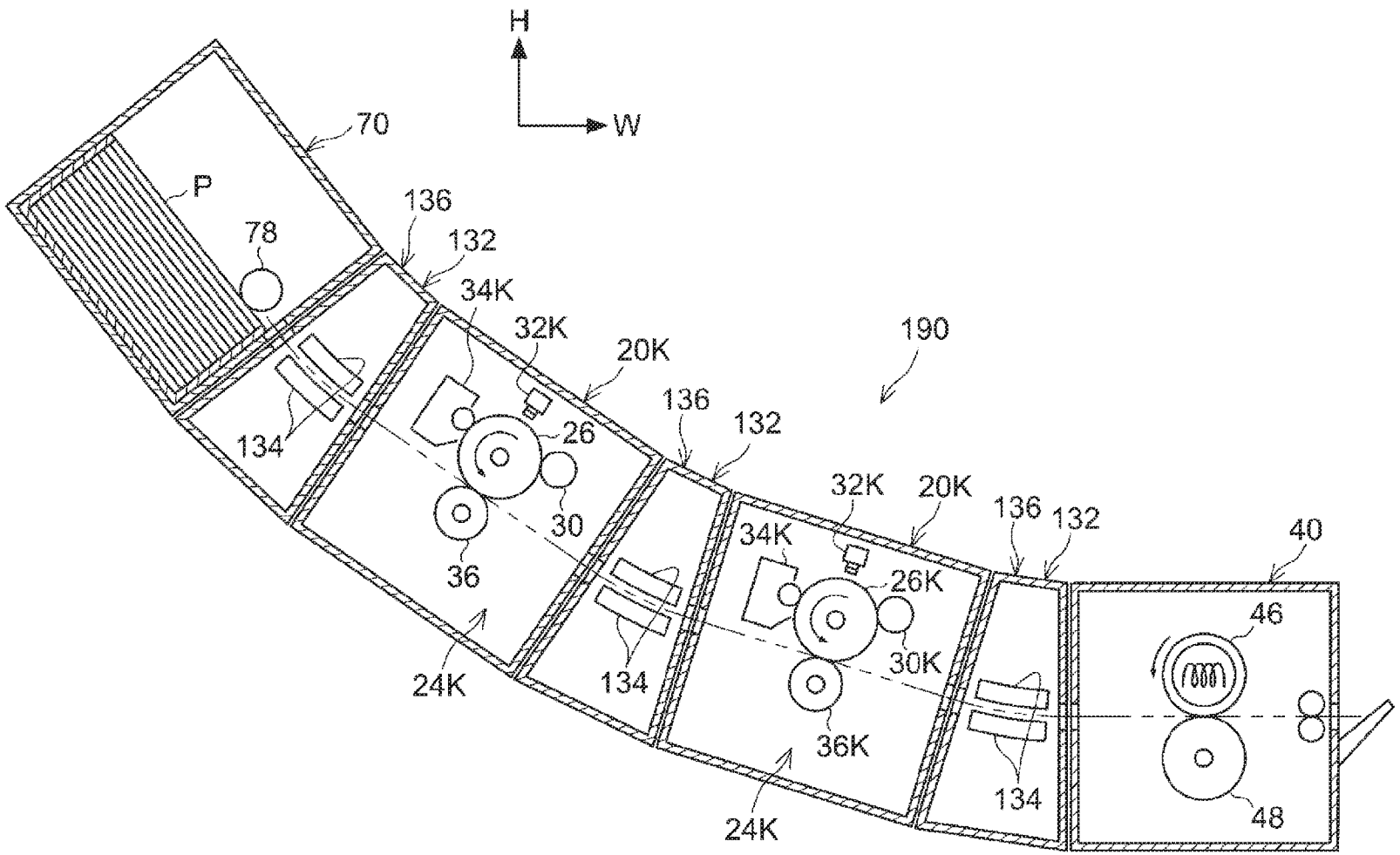
FIG. 14 is a schematic diagram of an image forming apparatus according to a sixth reference embodiment of the present invention.

Referring to FIG. 14, an image forming apparatus 190 according to the sixth reference embodiment includes a supplying device 70, a delivering device 132, a forming device 20K, another delivering device 132, another forming device 20K, yet another delivering device 132, and a fixing device 40 that are arranged in this order in the apparatus width direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

one or a plurality of forming devices that form respective images on a recording medium that is being transported;

a fixing device provided on a downstream side with respect to the one or at least one of the plurality of forming devices in a direction of transport of the recording medium and that fixes the images formed on the recording medium;

a delivering device that receives the recording medium transported in a first direction and discharges the recording medium in a second direction that is different from the first direction; and a supplying device that supplies the recording medium to the one or the plurality of forming devices or to the delivering device, wherein the one or the plurality of forming devices, the fixing device, the delivering device, and the supplying device have respective housings and each housing is directly connectable to each of the other housings to form the image forming apparatus.

2. The image forming apparatus according to claim 1, wherein the second direction is not perpendicular or parallel to the first direction.

3. The image forming apparatus according to claim 1, wherein the housing for the delivering device is configured to discharge the recording medium in the second direction that is opposite to the first direction.

4. An image forming apparatus comprising:

a plurality of first housings each having an inlet and an outlet through which a recording medium to be transported passes, each of the inlets and the outlets being at respective positions on a substantially straight virtual line when seen in a width direction of the recording medium that is being transported, the first housings each being directly connectable to each of the other first housings such that the outlet of one first housing faces the inlet of another first housing;

a forming unit provided in at least one of the plurality of first housings and that forms an image on the recording medium that is being transported;

a fixing unit that is provided on a downstream side with respect to the first housing having the forming unit in a direction of transport of the recording medium, the fixing unit fixing the image formed on the recording medium;

a second housing including a delivering unit, the second housing having an inlet at which the recording medium is received and an outlet from which the recording medium is discharged, the outlet of the second housing facing toward a second side that is different from a first side toward which the inlet of the second housing faces when seen in the width direction of the recording medium, the second housing being directly connectable to each of the first housings such that the inlet of the second housing faces the outlet of one of the plurality of first housings while the outlet of the second housing faces the inlet of another of the plurality of first housings; and a third housing provided at a most upstream position in the direction of transport of the recording medium and that includes a supplying unit, the supplying unit supplying the recording medium to any of the forming unit, the fixing unit, and the delivering unit, the third housing having an outlet from which the recording medium is discharged, the third housing being directly connectable to each of the plurality of first housings and the second housing such that the outlet of the third housing faces the inlet of any one of the plurality of first housings or the inlet of the second housing.

5. The image forming apparatus according to claim 4, wherein the second side is not perpendicular or parallel to the first side.

* * * * *